US007418916B1

(12) United States Patent
Oas

(10) Patent No.: US 7,418,916 B1
(45) Date of Patent: Sep. 2, 2008

(54) SIT-IN KAYAK

(75) Inventor: Stephen Oas, Erie, PA (US)

(73) Assignee: EMSCO Inc, Girard, PA (US)

( * ) Notice: Subject to any disclaimer, the term of this patent is extended or adjusted under 35 U.S.C. 154(b) by 0 days.

(21) Appl. No.: 11/824,184

(22) Filed: Jun. 29, 2007

(51) Int. Cl.
*B63B 35/71* (2006.01)
*B63B 17/00* (2006.01)

(52) U.S. Cl. ..... 114/347; 114/363

(58) Field of Classification Search ..... 114/343, 114/347, 357, 363, 364; D12/300, 302
See application file for complete search history.

(56) References Cited

U.S. PATENT DOCUMENTS 2,962,732 A * 12/1960 Marz ..... 114/347
2,999,253 A * 9/1961 Lewis ..... 114/347
D411,505 S * 6/1999 Boutemy ..... D12/300
D464,602 S * 10/2002 Metzger et al. ..... D12/302
D566,030 S * 4/2008 Oas ..... D12/302

FOREIGN PATENT DOCUMENTS

CA 2393107 A1 * 1/2004

* cited by examiner

*Primary Examiner*—Ajay Vasudeva
(74) *Attorney, Agent, or Firm*—Richard K. Thomson

(57) ABSTRACT

A series of channels formed in the bow portion of the deck create both a series of wave breakers and a plurality of footrests inside the passenger compartment of this sit-in kayak. The kayak is integrally molded in a single piece and has a contoured seat with a downwardly sloping, rearwardly directed portion. A combination of the footrests and the downwardly sloping, rearwardly directed portion increases leverage available during paddling.

5 Claims, 4 Drawing Sheets

SIT-IN KAYAK

BACKGROUND AND SUMMARY OF THE INVENTION

The present invention is directed to the field of water craft. More particularly, the present invention is directed to a sit-in kayak.

Kayaking has become increasingly popular, spurred to a significant degree, by the reduction in cost associated with plastic molded sit-on and sit-in kayaks. It is the object of the present invention to provide a sit-in kayak with enhanced features including multiple shock-absorbent foot rests and wave breakers which significantly reduce the amount of water from waves breaking over the bow which finds its way into the passenger compartment. The same indentations in the bow provide the dual function of forming both the footrests and wave breakers. The foot rests, in conjunction with a significant slope on the rear half of the seat, enable the paddler to get significant leverage with each stroke.

The sit-in molded kayak of the present invention includes a) a hull; b) a deck having a bow portion, an aft portion, and a central opening into a passenger compartment, the bow portion having a plurality of wave-breaking channels extending entirely across the bow portion, each of the channels having a first forward-most central section, and second and third sections which angle outwardly aft around the central opening; whereby when waves break over the bow portion, the wave-breaking channels captivate water from the waves and channel the water around the central opening.

The kayak further includes a plurality of footrests integrally molded into the bow portion, each foot rest including a forward directed surface and an aft directed surface, the aft directed surface receiving a toe and ball-of-the-foot portion of a kayaker's foot. The plurality of footrests are formed in pairs, one on a right side of the kayak and one on a left side of the kayak. Most preferably, each of the footrests is an underneath portion of one of the second and third sections of said wave-breaking channels. The kayak has a contoured seat molded in the passenger compartment, the contoured molded seat having a downwardly sloping, rearwardly directed portion, whereby a combination of the footrests and the downwardly sloping, rearwardly directed portion increase leverage available during paddling. Also, it is preferred that the sit-in molded kayak be integrally molded as a single piece.

Various other features, advantages, and characteristics of the present invention will become apparent after a reading of the following detailed description.

BRIEF DESCRIPTION OF THE DRAWINGS

The preferred embodiment(s) of the present invention is/are described in conjunction with the associated drawings in which like features are indicated with like reference numerals and in which.

DETAILED DESCRIPTION OF THE PREFERRED EMBODIMENT(S)

Figure 1:
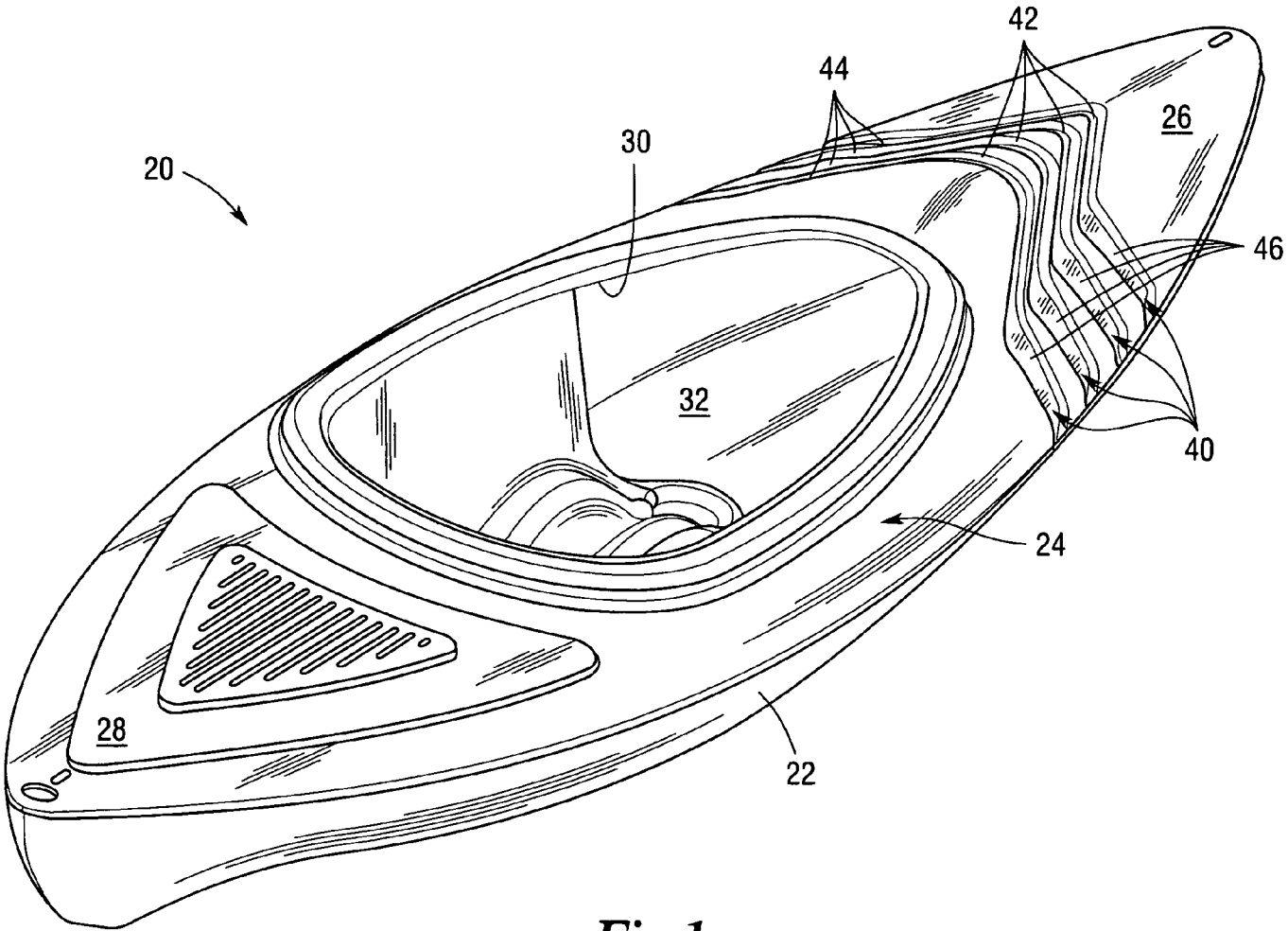
FIG. 1 is a perspective front view of a first embodiment of the sit-in kayak of the present invention.
Figure 2:
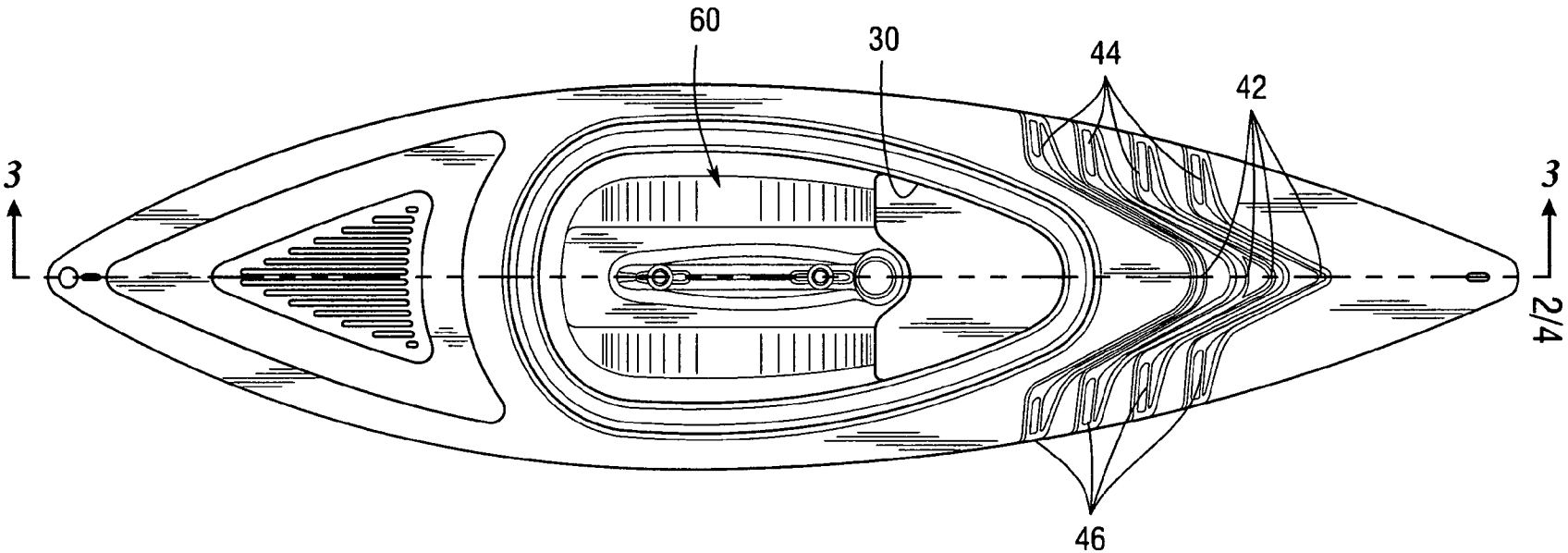
FIG. 2 is a top view of the first embodiment.

A first embodiment of the sit-in molded kayak of the present invention is depicted in FIGS. 1-4 generally at 20.

Sit-in kayak comprises a one-piece molded construction having a hull 22, a deck 24 having a bow portion 26 and an aft portion 28. Central opening 30 leads to passenger compartment 32. A plurality of wave-breaking channels 40 extend entirely across the bow portion 26 of deck 24. Each wave-breaking channel 40 has a V-shaped forward-most central section 42 and a second (44) and third (46) sections which angle outwardly aft around the opening 30. As a wave breaks over bow 26, forward-most channel 40 catches the first of the wave, dissipating its energy and channeling its water laterally around the passenger compartment 32. Water continuing beyond the forward-most channel is captured by the second, then third, and finally, the fourth channel 40 deflecting water from the wave laterally out around opening 30 and, hence, around compartment 32.

Figure 3:
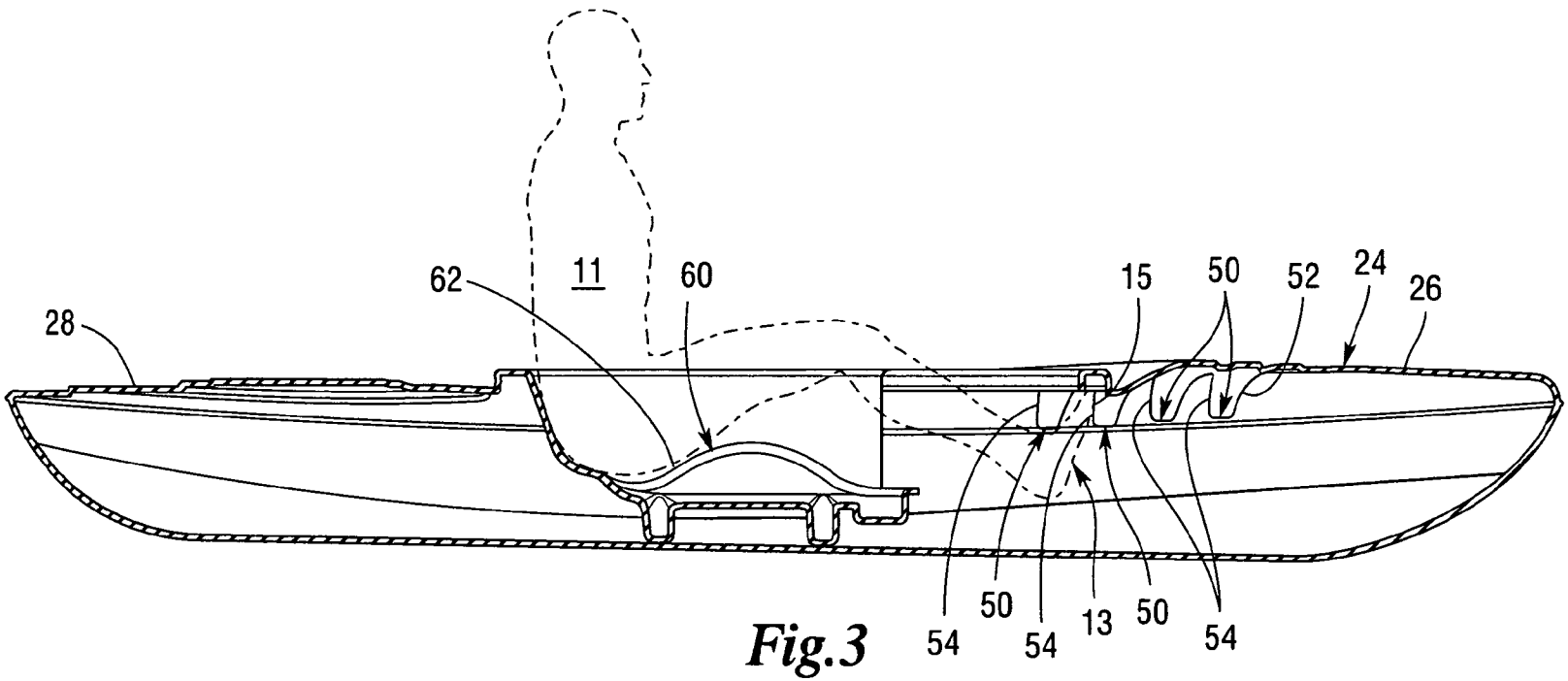
FIG. 3 is a cross-sectional side view as seen along line 3-3 of FIG. 2; and, FIG. 4 is a bottom view of the first embodiment.
Figure 4:
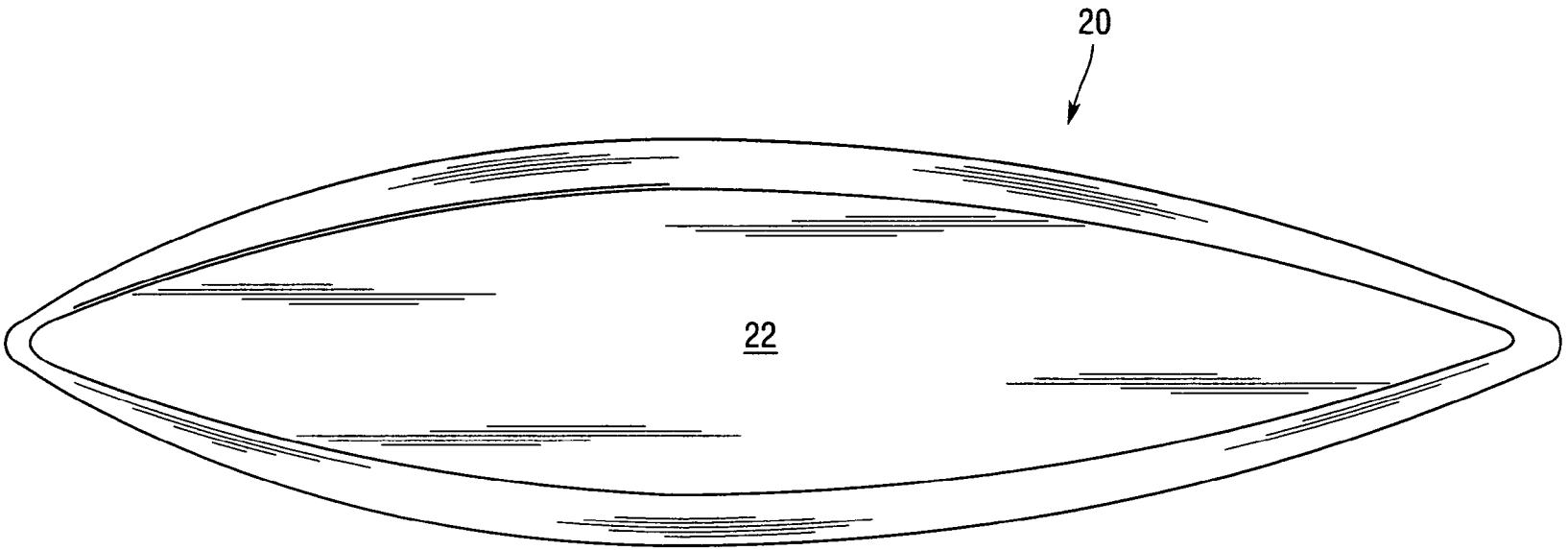

As best seen in FIG. 3, the plastic which is deflected to form channels 40 form footrests 50 having a forward-directed surface 52 and an aft-directed surface 54. Second and third channel sections 44, 46 form paired left and right footrests integrally molded from the deck 24. Aft-directed surface 54 receives a toe and ball-of-the-foot 15 of foot 13 of kayaker 11. Footrests 50, therefore, provide a secure foothold for kayaker 11 and, yet, the fact that footrests 50 have forward-directed surfaces 52 and aft-directed surfaces 54, enable them to provide a cushioning not available with any other kayak. In addition, while conventional footrests emanate from a side of the hull and, therefore, only provide access for a portion of the side of a ball-of-the-foot, the present footrests 50 formed as they are from the forward portion of bow 24, permit engagement by the toes and the entire ball-of-the-foot, a much more secure foothold which can be particularly important should moisture enter the compartment or wet shoes create slipperiness.

Contoured seat 60 is formed within the passenger compartment 32 (FIG. 3). Seat 60 has a downwardly sloping, rearwardly directed portion 62 which in combination with the footrests, enable the kayaker to have a significant increase in leverage available during paddling. In other kayaks, a considerable amount of energy is wasted in slipping to-and-fro in the seat. By enabling kayaker 11 to firmly plant her/himself in passenger compartment 32, each paddle stroke provides maximum forward impetus for the kayak 20. Although not shown here, a splash skirt can be provided to further ensure that the passenger compartment 32 of kayak 20 remains dry even in a rollover maneuver. While the one-piece molded design is preferred for strength and simplicity, obviously the features of the present invention could be incorporated in kayak designs employing two or more bonded pieces.

Various changes, alternatives, and modifications will become apparent to a person of ordinary skill in the art after a reading of the foregoing specification. For example, access to a dry compartment could be incorporated into the aft deck 28 to stow such items as a wallet or pocket book and car keys. It is intended that all such changes, alternatives, and modifications as fall within the scope of the appended claims be considered part of the present invention.

I claim:

1. A sit-in molded kayak comprising:

a) a hull;

b) a deck having a bow portion, an aft portion, and a central opening into a passenger compartment, said bow portion having a plurality of wave-breaking channels formed in an upper surface of the deck and extending entirely across said bow portion, each of said channels having a first forward-most central section, and second and third sections which angle outwardly aft around said central opening, whereby when waves break over said bow portion, said wave-breaking channels captivate water from the waves and channel the water around said central opening; and c) said bow portion further comprising a plurality of footrests depending from a lower surface of the deck and integrally molded into said bow portion, each foot rest including a forward-directed surface and an aft-directed surface, said aft-directed surface receiving a toe and ball-of-the-foot portion of a kayaker's foot.

2. The sit-in molded kayak of claim 1 wherein said plurality of footrests are formed in pairs, one on a right side of said kayak and one on a left side of said kayak.

3. The sit-in molded kayak of claim 2 wherein each of said plurality of footrests is a trough of one of said plurality of said second and third sections of said wave-breaking channels.

4. The sit-in molded kayak of claim 1 further comprising a contoured seat molded in said passenger compartment, said contoured molded seat having a downwardly sloping, rearwardly directed portion, whereby a combination of said footrests and said downwardly sloping, rearwardly directed portion increases leverage available during paddling.

5. The sit-in molded kayak of claim 1 wherein said kayak is integrally molded as a single piece.

* * * * *